US012029319B2

(12) United States Patent
Lin

(10) Patent No.: US 12,029,319 B2
(45) Date of Patent: Jul. 9, 2024

(54) SWINGABLE CHAIR CHASSIS

(71) Applicant: Chang-Chen Lin, Tainan (TW)

(72) Inventor: Chang-Chen Lin, Tainan (TW)

( * ) Notice: Subject to any disclaimer, the term of this patent is extended or adjusted under 35 U.S.C. 154(b) by 100 days.

(21) Appl. No.: 17/968,999

(22) Filed: Oct. 19, 2022

(65) Prior Publication Data

US 2023/0189995 A1 Jun. 22, 2023

(30) Foreign Application Priority Data

Dec. 22, 2021 (TW) ..... 110215259

(51) Int. Cl.

| | |
|---|---|
| ***A47C 3/02*** | (2006.01) |
| ***A47C 1/032*** | (2006.01) |
| ***A47C 3/025*** | (2006.01) |
| ***A47C 3/026*** | (2006.01) |
| ***A47C 7/44*** | (2006.01) |

(52) U.S. Cl.

CPC ..... *A47C 1/03255* (2013.01); *A47C 1/03288* (2013.01); *A47C 3/0252* (2013.01); *A47C 3/026* (2013.01); *A47C 7/448* (2013.01)

(58) Field of Classification Search

CPC ..... A47C 1/03255; A47C 1/03288; A47C 3/0252; A47C 3/026; A47C 7/448

USPC ..... 297/258.1, 270.1, 270.2, 270.3, 270.4, 297/302.1–303.1, 313, 314, 262.1

See application file for complete search history.

(56) References Cited

U.S. PATENT DOCUMENTS

| | | | | | |
|---|---|---|---|---|---|
| 273,630 | A * | 3/1883 | Stevens | A47C 3/027 | 297/262.1 |
| 317,933 | A * | 5/1885 | Doubler | A47C 3/027 | 297/262.1 |
| 346,311 | A * | 7/1886 | Parry | A47C 3/026 | 297/262.1 |
| 834,670 | A * | 10/1906 | Hrtzler | A63G 11/00 | 297/262.1 |
| 1,555,689 | A * | 9/1925 | Miller | A47C 3/027 | 297/262.1 X |
| 1,840,679 | A * | 1/1932 | Schauss | A47C 3/027 | 297/262.1 |
| 3,741,607 | A * | 6/1973 | Cramer | A47C 7/443 | 297/313 |
| 4,025,020 | A | 5/1977 | Goff et al. | | |

(Continued)

FOREIGN PATENT DOCUMENTS

| | | | | |
|---|---|---|---|---|
| DE | 202016106819 U1 * | 3/2017 | ..... | A47C 3/0252 |
| JP | 2021142212 A | 9/2021 | | |

*Primary Examiner* — Rodney B White

(74) *Attorney, Agent, or Firm* — Best & Flanagan LLP

(57) ABSTRACT

A swingable chair chassis comprises a rocker seat including a chamber defined between a bottom wall and a peripheral wall. The bottom wall includes a slot extending in a front/rear direction. A lid is securely mounted to a bottom of the seat and the rocker seat. A supporting seat is disposed in the chamber of the rocker seat. The supporting seat includes a central portion having an insertion hole coupled with chair post. The supporting seat includes an arcuate supporting face formed on an upper side thereof and abutting against a lower face of the lid. A plurality of elastic elements is disposed between the bottom wall of the rocker seat and the supporting seat and provides movement elasticity when the rocker seat swings forward or rearward relative to the supporting seat. The supporting face abuts against the lower face of the lid during swinging movement of the rocker seat.

9 Claims, 6 Drawing Sheets

(56) References Cited

U.S. PATENT DOCUMENTS 4,372,515 A * 2/1983 Noonan ..... F16M 11/10 248/371
4,890,886 A * 1/1990 Opsvik ..... A47C 7/448 248/596
5,577,803 A * 11/1996 Guilbaud ..... A47C 31/126 297/361.1
5,649,740 A * 7/1997 Hodgdon ..... A47C 1/03288 248/575
6,033,021 A * 3/2000 Udo ..... A47C 9/002 297/217.3
6,176,548 B1 * 1/2001 Thole ..... A47C 9/002 297/329
6,209,958 B1 * 4/2001 Thole ..... A47C 3/026 297/325
6,213,551 B1 * 4/2001 Desnoyers ..... A47C 3/025 297/270.3
6,688,689 B1 * 2/2004 Thorn ..... A47C 7/14 297/313
6,863,017 B2 * 3/2005 Charles ..... B60N 2/2839 267/131
7,100,983 B1 * 9/2006 Gant ..... A47C 3/025 248/656
7,234,772 B2 * 6/2007 Wells ..... A47C 3/027 297/316
7,396,080 B2 * 7/2008 Suhr ..... A47C 7/14 297/313
7,922,247 B2 * 4/2011 Dickie ..... A47C 7/14 297/264.1
7,938,487 B2 * 5/2011 Fismen ..... A47C 3/0252 297/302.6
8,366,193 B2 * 2/2013 Lin ..... A47C 3/0255 297/270.3
8,888,184 B2 11/2014 Meyer et al.
8,926,015 B2 * 1/2015 Viger ..... A47C 3/0255 297/259.3
9,211,013 B2 * 12/2015 Harrison ..... A47C 7/448
9,661,929 B1 * 5/2017 Koh ..... A47C 7/445
10,772,427 B2 * 9/2020 Schuppler ..... A47C 7/44
2005/0077768 A1 * 4/2005 Chen ..... A47C 1/026 297/313
2007/0241599 A1 * 10/2007 Hodgdon ..... A47C 1/023 297/313
2014/0252823 A1 * 9/2014 Risdall ..... A47C 7/448 297/239
2014/0252824 A1 * 9/2014 Saint Pierre ..... A47C 7/448 297/239
2015/0289656 A1 * 10/2015 Saint Pierre ..... A47C 3/00 297/239
2015/0351550 A1 * 12/2015 Saint Pierre ..... A47C 3/04 297/239
2018/0271291 A1 * 9/2018 Toland ..... A47C 7/448
2022/0117396 A1 * 4/2022 Taylor ..... A47C 1/03288
2023/0263306 A1 * 8/2023 Bisman ..... A47C 1/03255 297/300.1

* cited by examiner

SWINGABLE CHAIR CHASSIS

BACKGROUND OF THE INVENTION

The present invention relates to a swingable chair chassis and, more particularly, to a chair chassis that can swing forward/rearward and that provides improved support and movement stability.

A conventional chair includes a seat and legs. A chassis is mounted to the bottom side of the seat and is coupled with the legs, such that the seat can be reliably disposed on top of the legs. However, the seat cannot swing relative to the legs, providing less sitting comfort.

U.S. Pat. No. 4,025,020 discloses a rocker plate disposed on top of a base plate. Front springs and rear springs are disposed between a seat and the rocker plate below the seat. Upper and lower ends of the front and rear springs are coupled with the seat and the rocker plate, respectively, permitting the seat to swing relative to the base plate via the front and rear springs.

However, it is difficult to reliably couple the seat and the rocker plate with the upper and lower ends of the front and rear springs, such that the upper and lower ends of the front and rear springs are apt to disengage from the seat and the rocker plate. Furthermore, the seat is only supported by the front and rear springs, failing to provide stable support.

U.S. Pat. No. 8,888,184 discloses a chair including a tilting device disposed between a base and a seat plate above the base. The tilting device includes a bottom plate, a top plate, and an elastic body arranged between the bottom plate and the top plate. A bulge is provided on a central portion of the bottom plate and is connected with an upper end of a gas spring. The elastic body is annular and includes a central opening through which the bulge of the bottom plate extends. Thus, the elastic body is compressed when the seat plate tilts, and the elastic body provides restoring forces.

Although the above structure has simple components, the top plate below the seat plate and the bottom plate above the base are only supported by the elastic body, failing to provide reliable support and stable tilting movement.

JP2021142212 discloses a seat and a swing plate below the seat. A base plate is provided on top of a supporting column of a base. The swing plate is pivotably connected with a central portion of the base plate by a pivot. Springs are disposed between the swing plate and the base plate. Thus, the seat can swing about by a pivotal axis defined by the pivot, and the swing plate can compress the springs to permit swing motion by the returning forces of the springs.

The swing plate of the above structure must swing about the pivotal axis defined by the pivot, which results in a fixed arm of force exerted by the swing plate compressing the springs. Thus, the arm of force compressing the springs cannot be changed in response to the swinging height of the swing plate, such that compression of the springs is not easy and the swinging motion is not smooth.

BRIEF SUMMARY OF THE INVENTION

An objective of the present invention is to provide a chair chassis that can swing forward/rearward and that provides improved support and movement stability.

A swingable chair chassis according to the present invention is configured to be mounted between a base and a seat of a chair. A post extends vertically from the base. The swingable chair chassis comprises a rocker seat, a lid, a supporting seat, and a plurality of elastic elements. The rocker seat is made of a rigid material and includes a bottom wall. A peripheral wall extends upward from a periphery of the bottom wall, defining a chamber between the bottom wall and the peripheral wall. The chamber has an opening in an upper end thereof. The bottom wall includes a slot extending in a front/rear direction. The lid is made of a rigid material and is securely mounted to a bottom of the seat. The lid is securely mounted on top of the rocker seat and includes a lower face. The supporting seat is made of a rigid material and is disposed in the chamber of the rocker seat. The supporting seat includes a central portion having an insertion hole aligned with the slot of the rocker seat and configured to couple with the post. The supporting seat includes a supporting face on an upper side thereof. The supporting face is arcuate and abuts against the lower face of the lid. The supporting face includes a central portion, a front portion, and a rear portion. The plurality of elastic elements is disposed between the bottom wall of the rocker seat and the supporting seat. The plurality of elastic elements is configured to provide movement elasticity when the rocker seat swings forward or rearward relative to the supporting seat. The central portion, the front portion, or the rear portion of the supporting face abuts against the lower face of the lid during the swinging movement of the rocker seat.

In an example, a plurality of positioning members extends downward from the lower face of the lid and is arranged in the front/rear direction. A plurality of positioning holes is disposed on the central portion, the front portion, and the rear portion of the supporting face of the supporting seat, is arranged in the front/rear direction, and is aligned and engageable with the plurality of positioning members.

In an example, each of the plurality of positioning members is a conical member having a diameter which decreases away from the lower face of the lid.

In an example, at least two of the plurality of positioning members engages with at least two of the plurality of positioning holes during the swinging movement of the rocker seat relative to the supporting seat.

In an example, the slot of the rocker seat has a width slightly greater than a diameter of the post and is configured to prevent swinging motion of the rocker seat in a left/right direction.

In an example, the slot of the rocker seat includes a front stop edge and a rear stop edge at front and rear ends thereof, respectively. The front stop edge and the rear stop edge are configured to restrict a maximum swinging angle of the seat.

In an example, an upper side of the bottom wall of the rocker seat includes at least one lower receiving groove extending in the front/rear direction and having a lower pressing face configured to press against a lower end of a respective one of the plurality of elastic elements. The supporting seat includes at least one upper receiving groove aligned with the at least one lower receiving groove and having an upper pressing face configured to press against an upper end of a respective one of the plurality of elastic elements.

In an example, the plurality of elastic elements is made of elastic rubber material or elastic plastic material.

When a user sits on the seat, the lower face of the lid remains abutting against the supporting face of the supporting seat. Furthermore, the slot prevents swinging of the post in the left/right direction, providing enhanced sitting stability. During the swinging motion of the seat, the central portion, the front portion, or the rear portion of the supporting seat serves as a fulcrum, such that the rocker swings relative to the supporting seat. Furthermore, the conical shape of the positioning members permits easy coupling with the associated positioning holes, providing improved support and movement stability.

The upper pressing faces and the lower pressing faces can compress the elastic elements. Furthermore, when the swinging angle of the rocker seat increases, the distance between the contact position (of the supporting face and the lower face of the lid) and the compressed elastic elements also increases, such that the swinging angle of the rocker seat is in proportion to the returning forces of the elastic elements. This avoids insufficient returning force when the swinging angle is larger, thereby providing enhanced operating stability. Furthermore, no noise is incurred during movement of the elastic elements, providing enhanced operational quality.

The present invention will become clearer in light of the following detailed description of illustrative embodiments of this invention described in connection with the drawings.

DETAILED DESCRIPTION OF THE INVENTION

Figure 1:
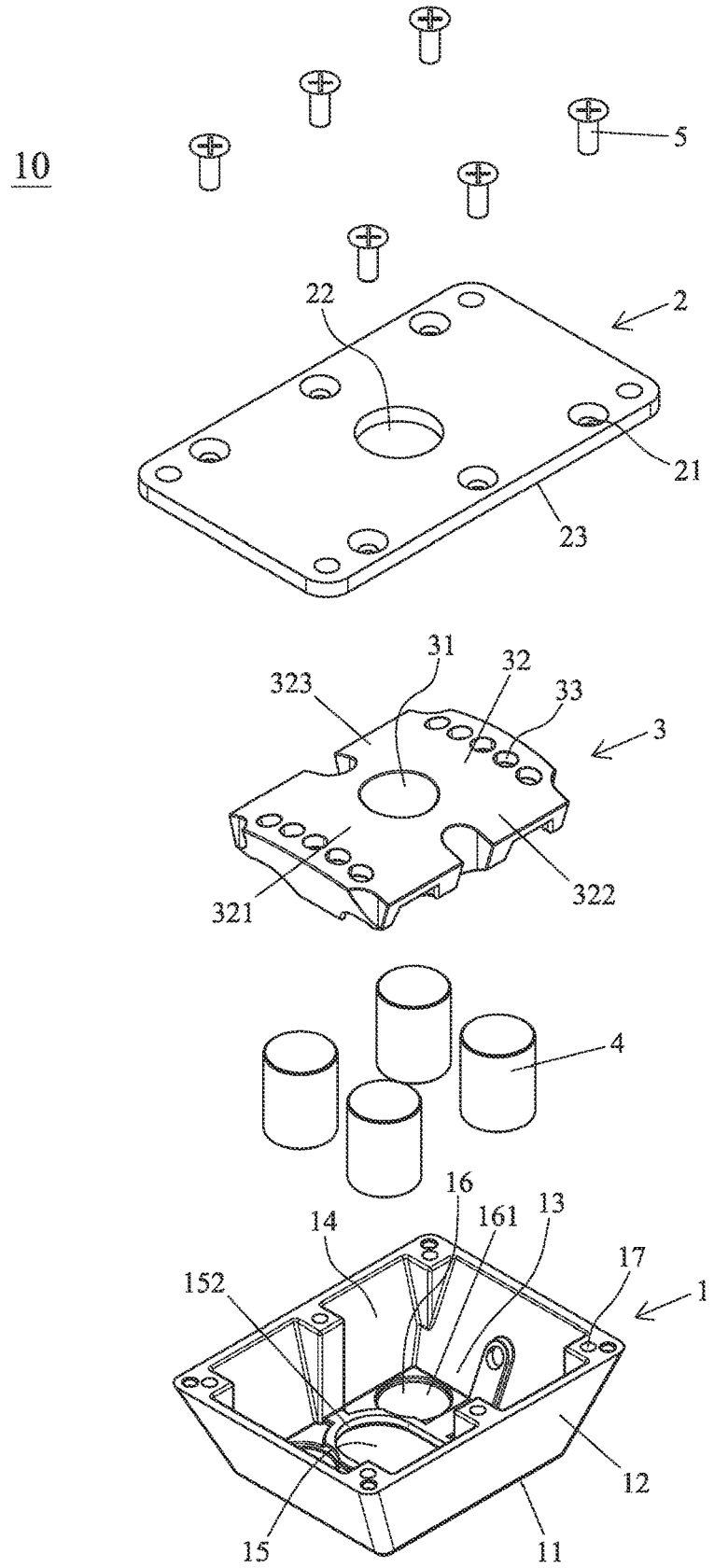
FIG. 1 is a top, perspective view of a swingable chair chassis of an embodiment example according to the present invention.
Figure 2:
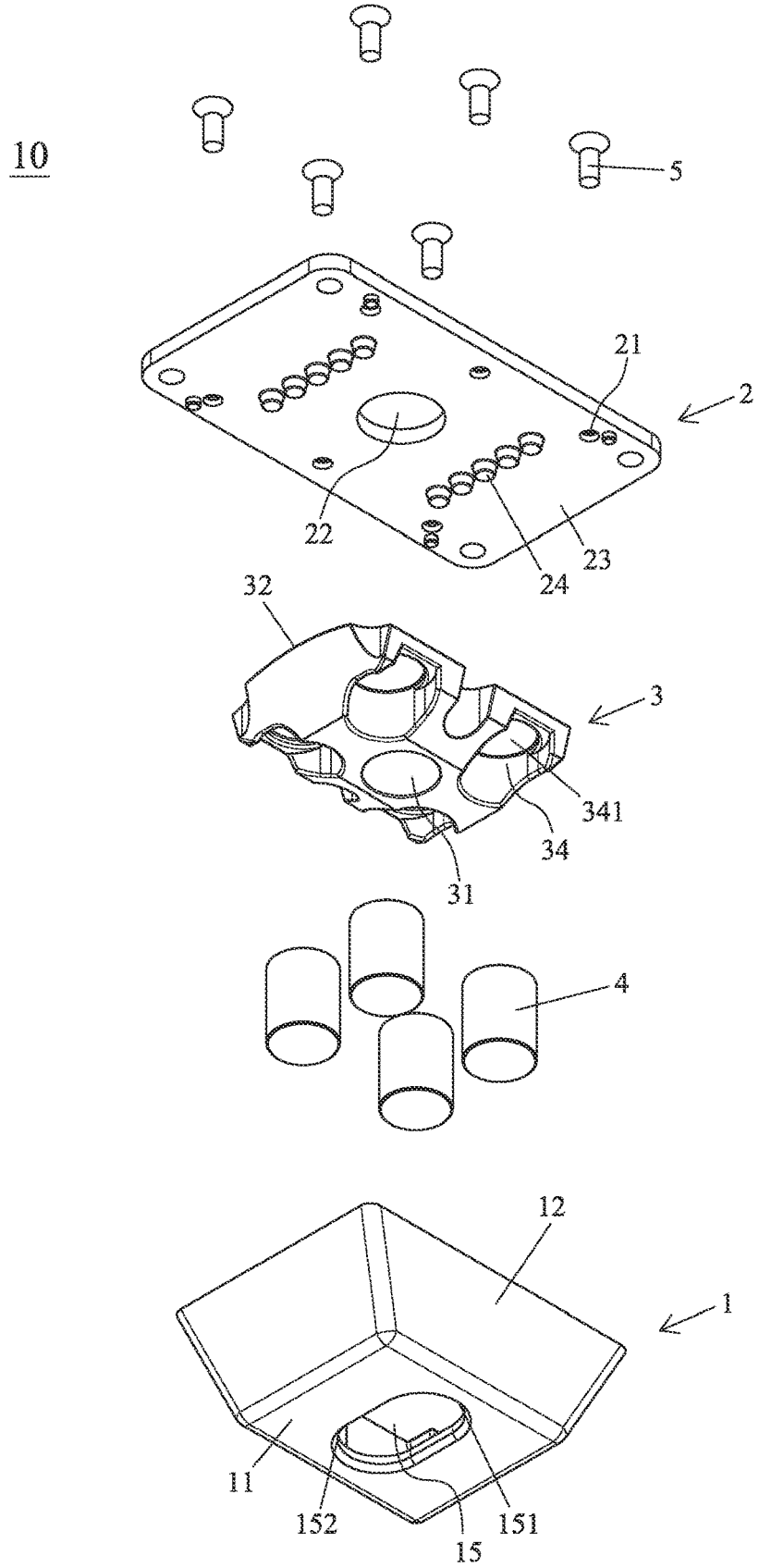
FIG. 2 is a bottom, perspective view of the swingable chair chassis of the embodiment according to the present invention.
Figure 3:
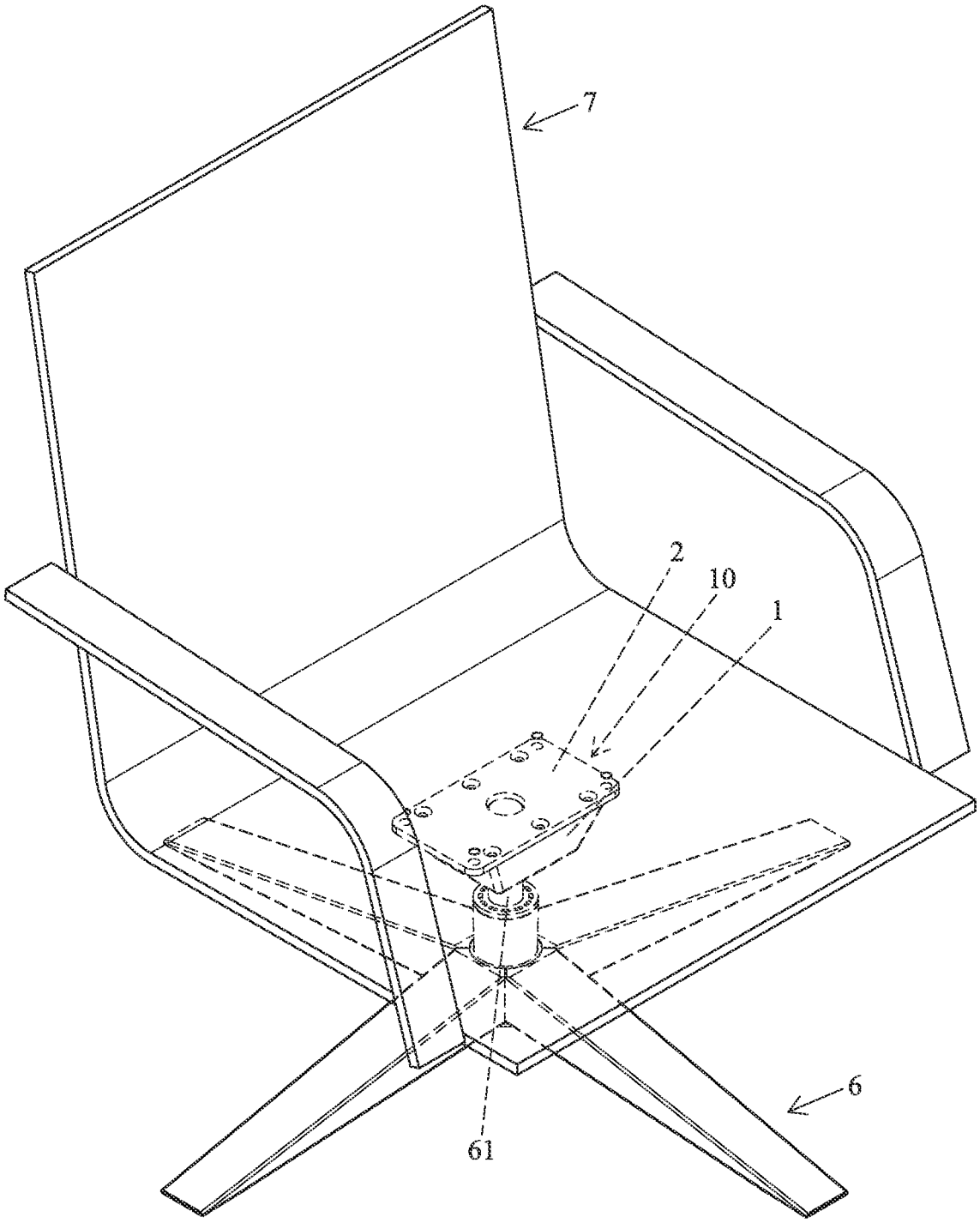
FIG. 3 is a schematic view of a chair equipped with the swingable chair chassis of the embodiment according to the present invention.

With reference to FIGS. 1-4, a swingable chair chassis 10 according to the present invention is configured to be mounted between a base 6 and a seat 7 of a chair. A post 61 extends vertically from the base 6. The swingable chair chassis 10 comprises a rocker seat 1, a lid 2, a supporting seat 3, and a plurality of elastic elements 4 (four elastic elements 4 in the example shown). The rocker seat 1 is made of rigid plastic, metal, or other rigid material and includes a bottom wall 11. A peripheral wall 12 extends upward from a periphery of the bottom wall 11, defining a chamber 13 between the bottom wall 11 and the peripheral wall 12. The chamber 13 has an opening 14 in an upper end thereof. The bottom wall 11 includes a slot 15 extending in a front/rear direction. The slot 15 of the rocker seat 1 has a width slightly greater than a diameter of the post 61 and is configured to prevent swinging motion of the rocker seat 1 in a left/right direction. The slot 15 of the rocker seat 1 includes a front stop edge 151 and a rear stop edge 152 at front and rear ends thereof, respectively. The front stop edge 151 and the rear stop edge 152 are configured to restrict a maximum swinging angle of the seat 7. An upper side of the bottom wall 11 of the rocker seat 1 includes two rows of lower receiving grooves 16, and each row has two receiving grooves 16 arranged in the front/rear direction. Each receiving groove 16 has a lower pressing face 161. Coupling holes 17 are formed on the peripheral wall 12.

The lid 2 is made of rigid plastic, metal, or other rigid material and is securely mounted to a bottom of the seat 7. The lid 2 is securely mounted on top of the rocker seat 1 and sealingly closes the opening 14 of the chamber 13 of the rocker seat 1. The lid 2 includes coupling holes 21. Fasteners 5 extend through the coupling holes 21 of the lid 2 and the coupling holes 17 of the rocker seat 1 to assemble the lid 2 and the rocker seat 1 together. The lid 2 further includes a central portion having a through-hole 22 through which the post 61 extends. The lid 2 further includes a lower face 23. A plurality of positioning members 24 extends downward from the lower face 23 of the lid 2 and is spaced from each other in the front/rear direction. Each of the plurality of positioning members 24 is a conical member having a diameter which decreases away from the lower face 23 of the lid 2. The positioning members 24 are equi-spaced. In this embodiment, two rows of positioning members 24 arranged in the front/rear direction are provided, and each row has five positioning members 24.

The supporting seat 3 is made of rigid plastic, metal, or other rigid material and is disposed in the chamber 13 of the rocker seat 1. The supporting seat 3 includes a central portion having an insertion hole 31 aligned with the slot 15 of the rocker seat 1 and configured to couple with the post 61. The supporting seat 3 includes a supporting face 32 on an upper side thereof. The supporting face 32 is arcuate and abuts against the lower face 23 of the lid 2. The supporting face 32 includes a central portion 321, a front portion 322, and a rear portion 323. A plurality of positioning holes 33 is disposed on the central portion 321, the front portion 322, and the rear portion 323 of the supporting face 32 of the supporting seat 3, is arranged in the front/rear direction, and is aligned and engageable with the plurality of positioning members 24. The supporting seat 3 includes upper receiving grooves 34 aligned with the lower receiving grooves 16. Each upper receiving groove 34 has an upper pressing face 341.

The plurality of elastic elements 4 is made of elastic rubber material or elastic plastic material and is disposed between the bottom wall 11 of the rocker seat 1 and the supporting seat 3. In this embodiment, there are four elastic elements 4 arranged in two rows in the front/rear direction. Each elastic element 4 is cylindrical and has an upper end received in an associated upper receiving groove 34 and pressing against a respective upper pressing face 341 and a lower end received in an associated lower receiving groove 16 and pressing against a respective lower pressing face 161. In other embodiments, the elastic elements 4 may be metal compression springs or made of material other than the rubber or plastic material. Furthermore, the shapes of elastic elements 4 may be varied.

Figure 4:
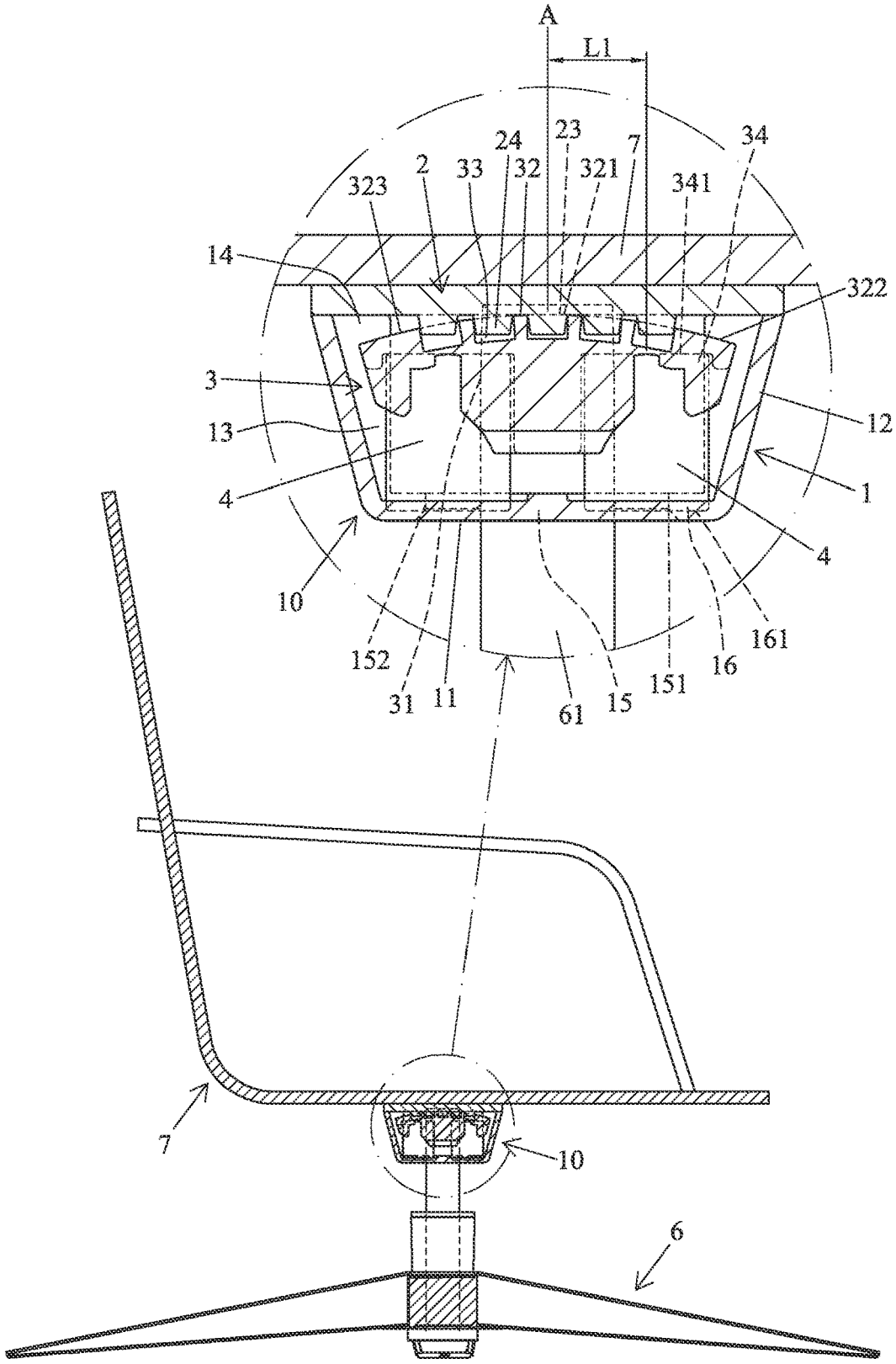
FIG. 4 is a cross sectional view of the chair.

When a user sits on the seat 7, the lower face 23 of the lid 2 remains abutting against the supporting face 32 of the supporting seat 3. As shown in FIG. 4, when the seat 7 is in a horizontal state, the lower face 23 of the lid 2 abuts against the central portion 321 of the arcuate supporting face 32 of the supporting seat 3, and the positioning hole 33 at the central portion 321 engages with associated positioning members 24 of the lid 2 to provide engaging stability. Furthermore, the slot 15 prevents swinging of the post 61 in the left/right direction, providing enhanced sitting stability.

Figure 5:
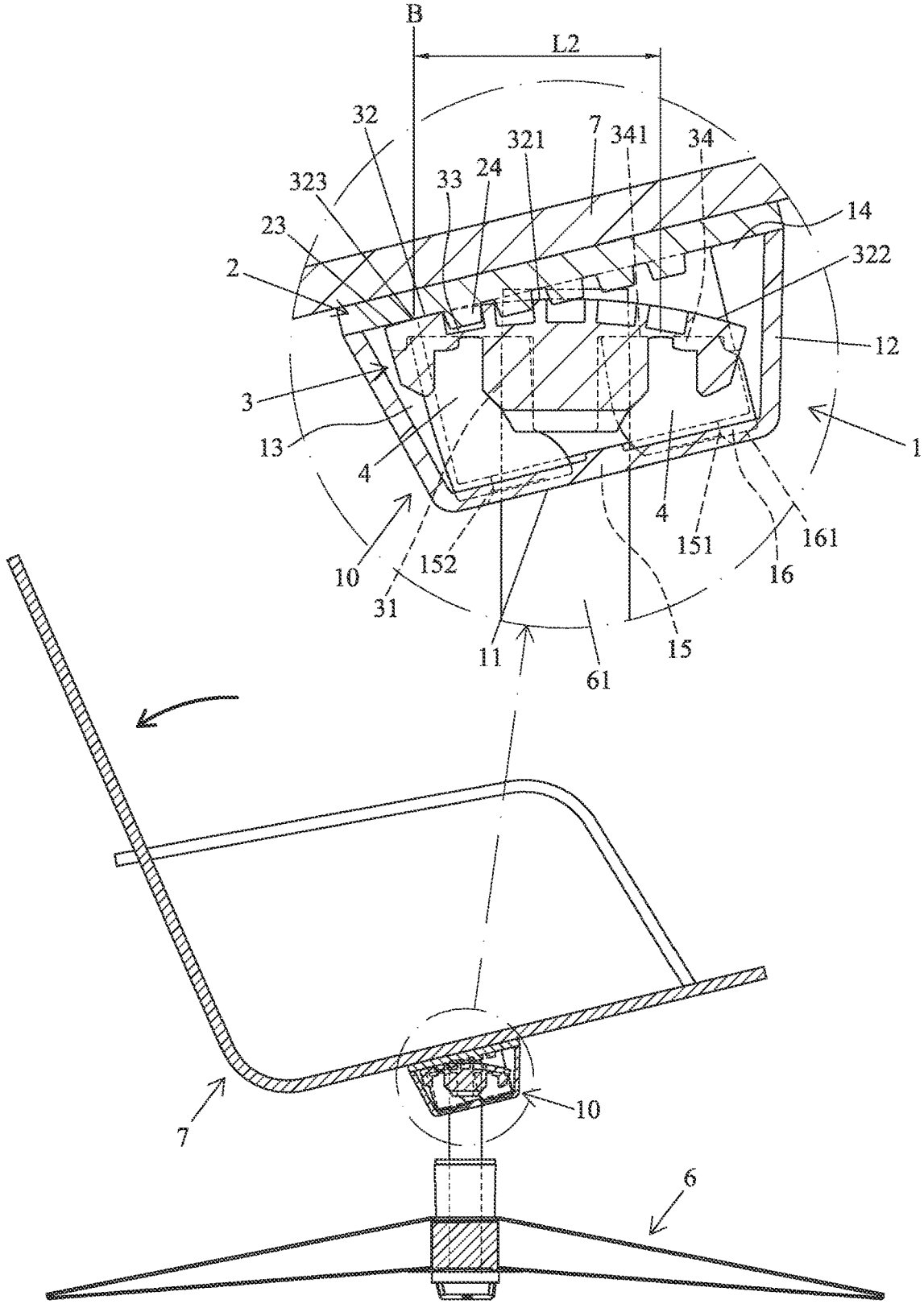
FIG. 5 is a cross sectional view illustrating rearward swinging of a seat.

When the seat 7 begins to swing rearward from the horizontal position, the central portion 321 of the supporting seat 3 serves as a fulcrum (as indicated by A in the enlarged circled portion of FIG. 4), and the arm of force exerted on the elastic elements 4 is L1. As shown in FIG. 5, the rocker seat 1 swings relative to the supporting seat 3. During the swinging procedure, the rear portion 323 of the supporting face 32 abuts against the lower face 23 of the lid 2, and the conical shapes of the positioning members 24 permit easy engagement of the positioning holes 33 at the rear portion 323 with the positioning members 24 at the rear portion of the lid 2, providing enhanced movement stability. At the same time, the upper pressing faces 341 and the lower pressing faces 161 compress the elastic elements 4 at the front side, and the contact position between supporting face 32 and the lower face 23 of the lid 2 becomes the fulcrum (as indicated by B in the enlarged circled portion of FIG. 5) for the rearward swinging when the swinging angle of the rocker seat 1 increases. At this time, the arm of force L2 exerted on the elastic elements 4 at the front side is greater than L1. Thus, the elastic elements 4 are further compressed when the arm of force increases due to an increase of the swinging angle of the rocker seat 1, and the swinging angle of the rocker seat 1 is in proportion to the returning forces of the elastic elements 4. This avoids insufficient returning force when the swinging angle is larger, thereby providing enhanced operating stability. Furthermore, no noise is incurred during movement of the elastic elements 4, providing enhanced operational quality.

Figure 6:
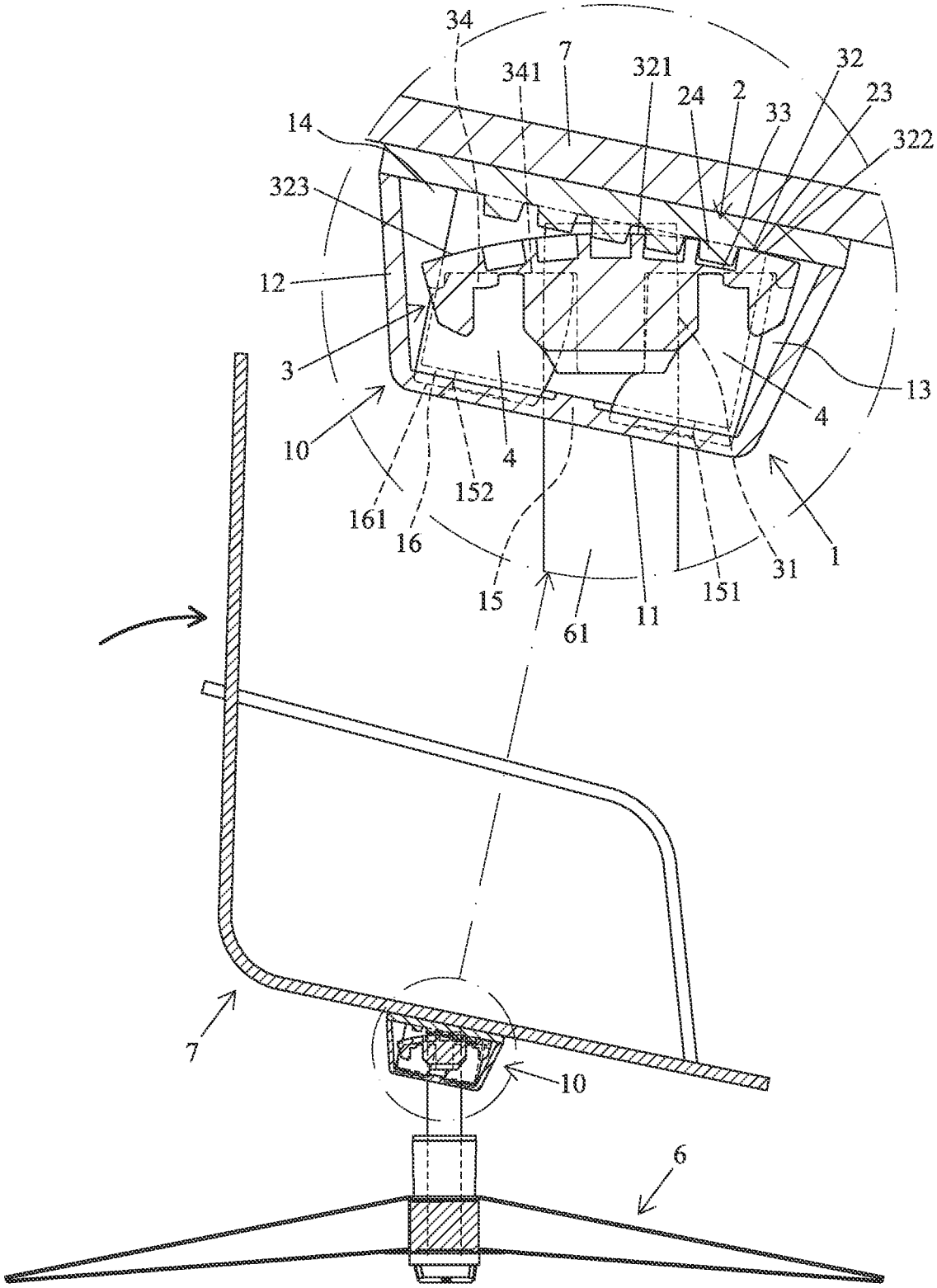
FIG. 6 is a cross sectional view illustrating forward swinging of the seat.

With reference to FIG. 6, the seat 7 can swing forward under the returning forces of the elastic elements 4, the positioning holes 33 at the front portion 322 of the supporting face 32 engage with the associated positioning members 24, and the elastic elements 4 at the rear side are compressed to provide returning forces for swinging motion. Thus, comfort forward/rearward swinging is provided. Furthermore, the front stop edge 151 and the rear stop edge 152 of the slot 15 abut the post 6 to restrict the maximum forward swinging angle and the maximum rearward swinging angle, providing enhanced movement stability. Furthermore, the compression and returning of the elastic elements 4 are carried out in the upper receiving grooves 34 and the lower receiving grooves 16 without deviation. Furthermore, at least two positioning members 24 engage with at least two positioning members 33 during swinging of the rocker seat 1, providing enhanced operating stability.

In view of the foregoing, the swingable chair chassis 10 according to the present invention can provide enhanced support and enhanced operational stability.

Although specific embodiments have been illustrated and described, numerous modifications and variations are still possible without departing from the scope of the invention. The scope of the invention is limited by the accompanying claims.

The invention claimed is:

1. A swingable chair chassis configured to be mounted between a base and a seat of a chair, with a post extending vertically from the base, with the swingable chair chassis comprising:

a rocker seat made of a rigid material and including a bottom wall, wherein a peripheral wall extends upward from a periphery of the bottom wall, defining a chamber between the bottom wall and the peripheral wall, wherein the chamber has an opening in an upper end thereof, and wherein the bottom wall includes a slot extending in a front/rear direction;

a lid made of a rigid material and securely mounted to a bottom of the seat, wherein the lid is securely mounted on top of the rocker seat and includes a lower face;

a supporting seat made of a rigid material and disposed in the chamber of the rocker seat, wherein the supporting seat includes a central portion having an insertion hole aligned with the slot of the rocker seat and configured to couple with the post, wherein the supporting seat includes a supporting face on an upper side thereof, wherein the supporting face is arcuate and abuts against the lower face of the lid, and wherein the supporting face includes a central portion, a front portion, and a rear portion;

a plurality of elastic elements disposed between the bottom wall of the rocker seat and the supporting seat, wherein the plurality of elastic elements is configured to provide movement elasticity when the rocker seat swings forward or rearward relative to the supporting seat, and wherein the central portion, the front portion, or the rear portion of the supporting face abuts against the lower face of the lid during the swinging movement of the rocker seat;

a plurality of positioning members extending downward from the lower face of the lid and is arranged in the front/rear direction; and a plurality of positioning holes disposed on the central portion, the front portion, and the rear portion of the supporting face of the supporting seat, the plurality of positioning holes arranged in the front-to-rear direction, each positioning hole of the plurality of positioning holes aligned and engageable with one of the plurality of positioning members.

2. The swingable chair chassis of claim 1, wherein each of the plurality of positioning members is a conical member having a diameter which decreases away from the lower face of the lid.

3. The swingable chair chassis of claim 1, wherein the plurality of positioning members is equi-spaced.

4. The swingable chair chassis of claim 1, wherein at least two of the plurality of positioning members engages with at least two of the plurality of positioning holes during the swinging movement of the rocker seat relative to the supporting seat.

5. A swingable chair chassis configured to be mounted between a base and a seat of a chair, with a post extending vertically from the base, with the swingable chair chassis comprising:

a rocker seat made of a rigid material and including a bottom wall, wherein a peripheral wall extends upward from a periphery of the bottom wall, defining a chamber between the bottom wall and the peripheral wall, wherein the chamber has an opening in an upper end thereof, and wherein the bottom wall includes a slot extending in a front/rear direction;

a lid made of a rigid material and securely mounted to a bottom of the seat, wherein the lid is securely mounted on top of the rocker seat and includes a lower face;

a supporting seat made of a rigid material and disposed in the chamber of the rocker seat, wherein the supporting seat includes a central portion having an insertion hole aligned with the slot of the rocker seat and configured to couple with the post, wherein the supporting seat includes a supporting face on an upper side thereof, wherein the supporting face is arcuate and abuts against the lower face of the lid, and wherein the supporting face includes a central portion, a front portion, and a rear portion; and a plurality of elastic elements disposed between the bottom wall of the rocker seat and the supporting seat, wherein the plurality of elastic elements is configured to provide movement elasticity when the rocker seat swings forward or rearward relative to the supporting seat, and wherein the central portion, the front portion, or the rear portion of the supporting face abuts against the lower face of the lid during the swinging movement of the rocker seat;

wherein the slot of the rocker seat has a width slightly greater than a diameter of the post and is configured to prevent swinging motion of the rocker seat in a left/right direction.

6. The swingable chair chassis of claim 5, wherein the slot of the rocker seat includes a front stop edge and a rear stop edge at front and rear ends thereof, respectively, and wherein the front stop edge and the rear stop edge are configured to restrict a maximum swinging angle of the seat.

7. A swingable chair chassis configured to be mounted between a base and a seat of a chair, with a post extending vertically from the base, with the swingable chair chassis comprising:

a rocker seat made of a rigid material and including a bottom wall, wherein a peripheral wall extends upward from a periphery of the bottom wall, defining a chamber between the bottom wall and the peripheral wall, wherein the chamber has an opening in an upper end thereof, and wherein the bottom wall includes a slot extending in a front/rear direction;

a lid made of a rigid material and securely mounted to a bottom of the seat, wherein the lid is securely mounted on top of the rocker seat and includes a lower face;

a supporting seat made of a rigid material and disposed in the chamber of the rocker seat, wherein the supporting seat includes a central portion having an insertion hole aligned with the slot of the rocker seat and configured to couple with the post, wherein the supporting seat includes a supporting face on an upper side thereof, wherein the supporting face is arcuate and abuts against the lower face of the lid, and wherein the supporting face includes a central portion, a front portion, and a rear portion; and a plurality of elastic elements disposed between the bottom wall of the rocker seat and the supporting seat, wherein the plurality of elastic elements is configured to provide movement elasticity when the rocker seat swings forward or rearward relative to the supporting seat, and wherein the central portion, the front portion, or the rear portion of the supporting face abuts against the lower face of the lid during the swinging movement of the rocker seat; wherein an upper side of the bottom wall of the rocker seat includes at least one lower receiving groove extending in the front/rear direction and having a lower pressing face configured to press against a lower end of a respective one of the plurality of elastic elements, and wherein the supporting seat includes at least one upper receiving groove aligned with the at least one lower receiving groove and having an upper pressing face configured to press against an upper end of a respective one of the plurality of elastic elements.

8. The swingable chair chassis of claim 1, wherein the plurality of elastic elements is made of elastic rubber material or elastic plastic material.

9. The swingable chair chassis of claim 1, wherein the lid sealingly closes the opening of the chamber of the rocker seat.

* * * * *